US011542712B2

(12) United States Patent
Baert et al.

(10) Patent No.: US 11,542,712 B2
(45) Date of Patent: Jan. 3, 2023

(54) PANEL AND METHOD OF PRODUCING A PANEL

(71) Applicant: Champion Link International Corporation, The Valley (AI)

(72) Inventors: Thomas Luc Martine Baert, Sint-Martens-Latem (BE); Tom Van Poyer, Jiaxing (CN); Sven Boon, Jiaxing (CN)

(73) Assignee: Champion Link International Corporation

( * ) Notice: Subject to any disclaimer, the term of this patent is extended or adjusted under 35 U.S.C. 154(b) by 0 days.

(21) Appl. No.: 17/084,795

(22) Filed: Oct. 30, 2020

(65) Prior Publication Data

US 2021/0285231 A1 Sep. 16, 2021

Related U.S. Application Data

(63) Continuation-in-part of application No. 16/817,866, filed on Mar. 13, 2020, now Pat. No. 11,149,441.

(51) Int. Cl.

| | |
|---|---|
| ***E04F 13/18*** | (2006.01) |
| ***E04F 13/075*** | (2006.01) |
| ***E04F 13/14*** | (2006.01) |
| ***E04F 13/08*** | (2006.01) |

(52) U.S. Cl.

CPC ..... *E04F 13/18* (2013.01); *E04F 13/075* (2013.01); *E04F 13/0866* (2013.01); *E04F 13/0889* (2013.01); *E04F 13/142* (2013.01)

(58) Field of Classification Search

CPC ... E04C 2/04; E04C 2/32; E04C 2/324; E04C 2/326

See application file for complete search history.

(56) References Cited

U.S. PATENT DOCUMENTS 2,944,291 A ‡ 10/1957 Prior ..... B28B 1/521 264/82
3,421,597 A ‡ 1/1969 Hans ..... G10K 11/165 181/290
3,931,428 A 1/1976 Reick
(Continued)

FOREIGN PATENT DOCUMENTS

CN 100419019 ‡ 2/2007
CN 101386516 3/2009
(Continued)

OTHER PUBLICATIONS

International Search Report and Written Opinion of Corresponding Application No. NL 2025119 dated Jan. 14, 2021.‡
(Continued)

*Primary Examiner* — Patrick J Maestri
(74) *Attorney, Agent, or Firm* — Emerson, Thomson & Bennett, LLC; Roger D. Emerson; Peter R. Detorre

(57) ABSTRACT

The invention relates to a panel for constructing a floor or wall covering. The panel comprises a substantially planar top surface, at least one core layer composed of a composite material which core layer is provided with the cavities, and a bottom surface. The panel further comprises at least one pair of opposite edges, said pair of opposite edges preferably comprising complementary coupling parts configured for mutual coupling of adjacent panels.

13 Claims, 6 Drawing Sheets

(56) References Cited

U.S. PATENT DOCUMENTS

Figure 1A:
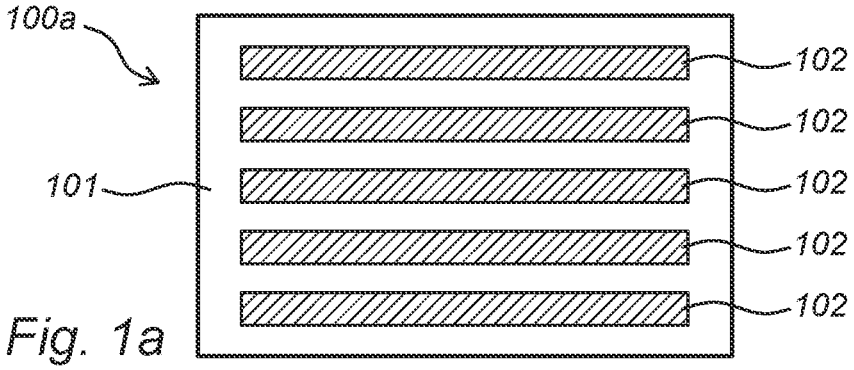

| | | | | |
|---|---|---|---|---|
| 4,278,728 | A | 7/1981 | Honda | |
| 4,446,190 | A * | 5/1984 | Pernici | E04F 15/08 428/156 |
| 5,336,551 | A | 8/1994 | Graiver | |
| 5,631,053 | A | 5/1997 | Andersen | |
| 5,776,580 | A | 7/1998 | Rasmussen | |
| 6,688,061 | B2 ‡ | 2/2004 | Garcia | B32B 23/04 52/311 |
| 6,761,794 | B2 | 7/2004 | Mott | |
| 6,933,043 | B1 | 8/2005 | Son | |
| 7,255,907 | B2 ‡ | 8/2007 | Feigin | B32B 13/14 428/70 |
| 7,399,510 | B2 | 7/2008 | Dupouy | |
| 7,918,062 | B2 ‡ | 4/2011 | Chen | B41J 2/005 52/311 |
| 8,287,991 | B2 | 10/2012 | Donelson | |
| 8,419,877 | B2 | 4/2013 | Pervan | |
| 10,328,680 | B2 | 6/2019 | Pervan | |
| 10,828,881 | B2 | 11/2020 | Bergelin | |
| 2005/0208258 | A1 | 9/2005 | Hosokawa | |
| 2005/0286397 | A1 | 12/2005 | Inagaki | |
| 2007/0033891 | A1 | 2/2007 | Imbabi | |
| 2008/0149137 | A1 | 6/2008 | Steinbrenner | |
| 2008/0318004 | A1 | 12/2008 | Ruhe | |
| 2009/0011279 | A1 ‡ | 1/2009 | Wisenbaker, Jr. | E04C 2/04 428/70 |
| 2009/0017320 | A1 | 1/2009 | Donelson | |
| 2009/0155612 | A1 | 6/2009 | Pervan | |
| 2009/0235607 | A1 ‡ | 9/2009 | Chen | E04F 15/02161 52/630 |
| 2009/0308001 | A1 | 12/2009 | Wu | |
| 2010/0115974 | A1 | 5/2010 | Okaza | |
| 2011/0067336 | A1 | 3/2011 | McDonald | |
| 2013/0295346 | A1 | 11/2013 | Ferguson | |
| 2014/0087156 | A1 | 3/2014 | Sarkis | |
| 2014/0134402 | A1 ‡ | 5/2014 | Pallon | B32B 9/002 428/15 |
| 2014/0272302 | A1 | 9/2014 | Ciuperca | |
| 2015/0059621 | A1 | 3/2015 | Hauber | |
| 2016/0288447 | A1 | 10/2016 | Cordeiro | |
| 2017/0204616 | A1 ‡ | 7/2017 | Scholz | E04F 15/107 |
| 2017/0217133 | A1 ‡ | 8/2017 | Jordan | B32B 21/14 |
| 2018/0147873 | A1 | 5/2018 | De Mondt | |
| 2018/0258651 | A1 | 9/2018 | Meersseman | |
| 2018/0283014 | A1 ‡ | 10/2018 | Hodgkins | B32B 21/047 |
| 2019/0308914 | A1 | 10/2019 | Kong | |
| 2020/0039190 | A1 | 2/2020 | Lenaerts | |

FOREIGN PATENT DOCUMENTS

| | | | |
|---|---|---|---|
| CN | 110607893 | | 12/2019 |
| DE | 102012000468 | | 7/2013 |
| EP | 2060389 | ‡ | 5/2009 |
| EP | 2690142 | | 1/2014 |
| EP | 3536874 | ‡ | 9/2019 |
| JP | H0828015 | ‡ | 1/1996 |
| KR | 20140066086 | ‡ | 5/2014 |
| SE | 19503648 | ‡ | 2/2019 |
| SE | 19503648 | | 3/2019 |
| WO | 2012061300 | | 5/2012 |
| WO | WO-2012061300 | ‡ | 5/2012 |
| WO | 2014007738 | | 1/2014 |
| WO | WO-2014007738 | ‡ | 1/2014 |
| WO | 2018234561 | | 12/2018 |
| WO | 2019064113 | | 4/2019 |
| WO | 2020114645 | | 6/2020 |
| WO | 2020197475 | | 10/2020 |
| WO | WO-2020197475 | ‡ | 10/2020 |

OTHER PUBLICATIONS

International Search Report and Written Opinion of corresponding PCT Application No. NL2025684, dated Mar. 3, 2021.‡

* cited by examiner
‡ imported from a related application

PANEL AND METHOD OF PRODUCING A PANEL

The invention relates to a panel, in particular a floor panel, wall panel or ceiling panel. The invention also relates to a method for producing such panel.

The market of rigid floating floors has known a significant growth over the past years, evolving from thin flexible strips of vinyl or LVT (Luxury Vinyl Tiles) to thick, rigid engineered hybrid products integrating multiple layers that feature multiple benefits such as an unprecedented stability under temperature fluctuations, reduced chance of telegraphing or deformation on uneven subfloors and increased lock strength between panels. This development towards more rigid floor panels, typically having a polymeric core is carried by products such as WPC (Wood Plastic Composite, in effect a foamed PVC core with or without wood particles, and a density of around 900 kg/m3) and SPC (Stone Plastic Composite, a solid PVC core with a density of around 2000 kg/m3). Compared to WPC, SPC has a superior dimensional stability when subjected to temperature fluctuations, allowing for a larger installation surface area, and installation in hot and high-traffic areas. Another advantage of solid core SPC compared to low density WPC is its resistance to impacts and indentations. A disadvantage inherent to solid core SPC however is that its acoustic performance is unsatisfactory. Its sound performance underperforms with respect to the more flexible and soft LVT and WPC. In general, it can be said that an increase in filler or mineral content in the product, leads to a higher rigidity and an improved dimensional stability; but also to a worse acoustic performance. Acoustical performance in the flooring industry is understood as both the amplitude reduction of a sound wave when moving through the flooring (sound transmitted to room below) as well as reduction of amplitude when tested for reflected walking sound (the sound heard in the same room). The transmission sound reduction can be tested as "Delta IIC" (USA) or "Delta Lw" (Europe, Australia). These two test methods give an indication of the sound transmission reduction to the room below due to the decorative flooring, in simple terms being the difference between sound transmission with or without the decorative flooring installed. To improve (reduce) the amplitude of the transmitted sound, an underlay can be installed between the decorative flooring and the subfloor, or an acoustic pad can be adhered to the back surface of the decorative flooring in the factory. Per illustration, a 4 mm SPC with a 1 mm pre-attached EVA backing can expect to reach a Delta Lw result of 12 dB; a WPC product with the same specifications generally reaches 20 dB. The lower density of the WPC allows for an improved sound absorption. Alas, as it contains a comparatively low ratio of mineral content, it is therefore inherently less dimensionally stable compared to the solid core SPC. There is therefore need for a flooring product that features the benefits of both an SPC panel (rigid, no telegraphing, stable, indentation resistance) and a WPC panel (lower weight and improved acoustical performance).

It is known in the prior art to apply "grooves" on the back of a wood-based or thermoplastic flooring panel to improve stability and increase flexibility. These grooves are generally applied through removal of material by cutting with a saw blade or carving with a tool. It is also known to apply grooves to extruded thermoplastic flooring panels through clever shaping of the extruding mould through which the single-piece support plate is extruded, thereby forming "strip-shaped recesses" that follow the direction of extrusion. Both production methods result in linear designs of the bottom surface texture. In effect these panels feature a linear or longitudinal design where the boundaries of the cavities applied to the bottom surface of the floor panels are one-directional on the plane of the bottom surface. Although the applied grooves may have at least one boundary that defines the exit or entry point of the tool used for their application, at least 90%, often more than 95%, most often more than 98% of the entire perimeter of these linear or longitudinal cavities or grooves have boundaries that are linear and parallel to one another. These longitudinal cavity boundaries form a line between the point of entry into the panel and their point of exit. Typically, the applied grooves are defined therefore by boundaries that are dominantly facing in a single direction, equal to the direction of the cutting or extrusion process through which they were applied. When there is a plurality of these grooves present on the back surface, they are present with the dominant linear or longitudinal boundaries parallel to one another and facing in the same direction. As a first example, a 2 mm cut groove applied across a floor board of 200 mm width running from edge to edge has boundaries that 100% run in the direction of the cutting process. As a second example, a 10 mm extruded groove applied in the length of the board running from edge to edge has boundaries that 100% run in the direction of the extrusion process. As a third example, a 2 mm cut groove that does not run from edge to edge and is applied in the length of the board, necessarily has a length that is a multiple of the entry point and length of the cutting tool, for example 300 mm, which translates in 99.4% of the boundaries running in the direction of the cutting process. A plurality of these applied grooves have boundaries running parallel to one another, forming a linear design. These linear designs suffer from an unbalanced rigidity and dimensional stability. Such panels suffer from a rigidity that is lower perpendicular to the direction of the applied grooves, than in the direction of the applied grooves, which may lead to warping when subjected to normal use or temperature fluctuations. Such panels also miss opportunities for acoustic improvement as they do not allow for more complex acoustical designs.

It is a goal of the current invention to provide a panel which at least partially has benefits of a panel with reduced weight and solve at least one of the shortcomings of the prior art.

The invention provides thereto a panel, in particular a floor panel, a wall panel, or a ceiling panel, comprising at least one core layer, the core layer having a top surface and a bottom surface, wherein at least part of the bottom surface of the core layer is provided with a plurality of impressed cavities. The core layer preferably comprises a composite material. Said core layer, in particular said composite material, preferably comprises a mineral material and/or polymer material which may be present in an amount of at least 20% by weight of said core layer. Optionally, said core layer comprises one or more additives, such as a binder. In a preferred embodiment, the composite material comprises (a mixture of) mineral material and a binder, such as an organic or inorganic binder. The panel according to the present invention is in particular configured for constructing a floor, wall or ceiling covering. The combination of a panel having a composite core layer comprising a mixture of mineral material and preferably a thermoplastic material, which composite material comprises at least 20% by weight of mineral material, and at least part of the bottom surface of said core layer being provided with the cavities extending towards the top surface of said core layer enables that the panel experiences an improved acoustical performance and reduced weight with respect to substantially solid panels, without compromising on the rigidity or indentation resistance of the panel. Due to the core layer of the panel comprising a composite material which comprises a mineral material, whereof at least 20% by weight is mineral material, a substantially rigid panel can be obtained. The presence of a core layer comprising at least 20% by weight of mineral material contributes to an increase of the rigidity of the panel in view of a panel having a core layer which is substantially entirely made of a thermoplastic material. Compared to a flexible panel, a substantially rigid panel facilitates relatively easy handling, and/or installation. Further, a substantially rigid panel is better equipped to bridge slight bumps and undulations in a subfloor without transferring them to the surface. This is in particular beneficial for use as floor panel, but rigidity of the panel may also be of benefit in case the panel is used as wall panel or ceiling panel. However, as outlined above, rigid panels typically experience an unsatisfying acoustic performance. This drawback is overcome by at least part of the bottom surface of the core layer being provided with a plurality of impressed cavities. The presence of the plurality of (impressed) cavities in the core layer causes at least a reduction of material in the core layer. This may affect the absorption, transmission, reflection, refraction and/or the diffraction of sounds waves interacting with the panel. It is experimentally found that the combination of a composite core being provided with cavities according to the present invention provides a positive effect on the acoustic performance of the panel, wherein a sound dampening effect is obtained. This is beneficial as it may eliminate the requirement of using an additional sound dampening layer underneath the panel, or on the top of the back surface. Another benefit of the combination of the composite material and the cavities according to the present invention is that the rigidity of the composite material may prevent undesired vibration and flexibility of the panel during use. This is also positive for the overall performance of the panel during use. Impressed cavities have to be understood as cavities mechanically pressed into the bottom surface of the core layer during production. This mechanical impressing step is preferably performed when the core layer is sufficiently soft, which is typically realized prior to subsequent (further) curing and/or (further) hardening of the core layer.

At least part of the bottom surface of the core layer panel is typically substantially planar. In particular, the bottom surface generally defines a substantially planar surface. When it is referred to a cavity also the terms recess, opening, and/or depression could be used. The cavity is typically a localized recess formed in the back planar surface of the panel during the production process, beneficially immediately after extrusion, or during hot pressing, or right before curing of the composite material forming the core of the panel. The panel is a typically a waterproof panel. Due to the good acoustic performance of the panel, the panel could also be referred to as acoustic panel.

It is conceivable that the boundaries of the cavities are multidirectional on the plane of the bottom surface. The panel according to the present invention benefits from the presence of cavities wherein the boundaries of the cavities are multidirectional on the plane of the bottom surface. In general, flooring can be subjected to a wide range of sound waves, such as footfall noise, television or radio sounds, talking sounds, the sound of a crying baby, the noise produced by falling objects etc. As sound waves are vibrations that travel easily in a solid direct pathway, flooring panels that lack any geometry on the bottom surface have a very narrow band of sound wavelength attenuation. To improve sound attenuation, it is possible to either stop or absorb, or direct the vibration into another direction, dissipating the sound wave. The presence of cavities in the back of the plank create extra surfaces for the shockwave to transfer through. Panels featuring grooves on the bottom surface are expected to perform slightly better than panels without any geometry, but still only attenuate a very limited band of wavelengths, as they are only able to dissipate the sound in one direction. The panel of the current invention improves greatly upon this by providing a flooring panel of limited thickness that is able to attenuate sound waves due to the presence of cavities that dissipate sound waves in multiple directions, greatly increasing the acoustically absorptive surface area. To this end, when the cavities feature boundaries that are multidirectional, they greatly improve upon the state of the art which only features one-directional dissipation.

The panel according to the present invention may comprise, and benefit, from cavities with sizes specifically designed to attenuate sound waves at a certain frequency. It is possible to apply a plurality of cavities with different sizes specifically designed as to increase the band of attenuated wavelengths. Further, impressed cavities typically have clear boundaries. Due to the cavities having clear boundaries, the cavities also function as attenuation chambers. This greatly improves upon the state of the art, which strip-shaped recesses or grooves cannot optimally reduce frequencies. The cavities according to the invention can be "tuned" by forming them with suitable length, width and depth dimensions to provide passive sound wave cancellation through resonance. The cavities may therefore be present in a combination of different shapes, lengths, widths and depths, thereby being present in a combination of different sizes, to provide an optimal sound wave cancellation. Preferably at least one of the dimensions of the cavities is approximately ⅕ to ⅓, more preferably around ¼th the wavelength of the target frequencies to be attenuated, thereby forming resonant chambers that are, according to empirical tests, able to optimally absorb the target frequencies. The target dimensions of the cavities can then be calculated by the formula "wavelength=speed of sound/frequency". Target frequencies are those that pose the largest range of noise in residential use, especially high-pitched noises transmitted to the room below when walked upon the flooring surface, ranging from 1,000-25,000 Hz, more preferably 4,000-20,000 Hz, most preferably 8,000-16,000 Hz. For example, at least a number of cavities can be configured to attenuate sound, preferably sound with a frequency ranging from 20-25,000 Hz, preferably 2,000-20,000 Hz, more preferably 8,000-16,000 Hz. It is also conceivable that at least a number of cavities is configured to attenuate sound with a frequency ranging from 500 to 10,000 Hz. The maximum length and/or maximum width of at least a number of cavities could range from 2 to 15 mm, most preferably 5 mm to 10 mm. Based on aforementioned formula, the optional dimension for cavities to attenuate flooring noise in dwellings meant for residential and commercial purposes are therefore found to range from 2-15 mm, most preferably 5 mm to 10 mm width and/or length in the plane of the back surface. Optimal volumes to attenuate flooring noise in dwellings meant for residential and commercial purposes are empirically found to range from 5 cubic millimeter to 2 cubic centimeter, more preferably from 0.1 cubic centimeter to 0.6 cubic centimeter. This would typically result in on average at least a 4 dB reduction in sound amplitude compared to one-directional and 5 dB reduction compared to solid core flooring panels. It is conceivable that at least part of the cavities have differing volumes to attenuate different target frequencies.

At least one cavity may have, and preferably a plurality of cavities may have, a maximum width W and a maximum length L, wherein the ratio between the maximum width W and the maximum length L is between 0.2 and 1, preferably between 0.5 and 1. Possibly, the depth of at least one cavity varies as seen in at least one cross-sectional direction of said cavity. It is further conceivable that the depth of at least a number of cavities is situated in between 10 and 30% of the maximum thickness of the core layer.

The panel according to the present invention may for example be a substantially longitudinal panel. This is in particular beneficial in case the panel is used as floor panel. However, it is also conceivable that the panel is substantially rectangular, rhombic, or polygonal. The panel could be a rectangular panel defining a first longitudinal direction, wherein at least of number of cavities has an elongated shape defining a second longitudinal direction, wherein the first longitudinal direction and the second longitudinal direction mutually enclose an angle, preferably an angle falling within the range of 30-90 degrees.

The plurality of impressed cavities may be present in a predetermined pattern. The cavities may for example extend from a first distal end of the panel to a second distal end of the panel. In such embodiment, said first distal end typically opposes said second distal end. It is also conceivable that the cavities are positioned at a predetermined distance from an edge of the panel. It is for example conceivable that the cavities do not extend through an (outer) edge of the panel. Hence, the cavities may be substantially centrally positioned. It is found this is beneficial for the sound absorbing properties of the panel. Such embodiment additionally ensures that the stability and flexibility of the panel are not negatively affected by the cavity, or cavities if applied, as there is a pull-back strength provided by the bottommost surface thus formed. A non-limiting example of a predetermined pattern is for example a zig-zag pattern. It is also conceivable that the plurality of impressed cavities comprises a repeated cavity pattern. It is further conceivable that at least part of the cavities define a cell pattern and/or a grid pattern.

In a preferred embodiment of the panel, at least part of the bottom surface of the core layer is provided with a plurality of cavities. It is for example possible that the cavities are provided such that the (predetermined) pattern of cavities influences the acoustic properties, and in particular the sound dampening properties, of the panel. For such embodiment, typically the cavities extend in at least two direction within the same (horizontal plane). This may for example be the x- and z-direction, considering the cavity extends from the bottom surface towards the top surface of the core in the y-direction. The cavities may for example extend in at least two direction within a plane defined by the bottom surface of the core layer. Possibly, the cavities may extend in a direction other than the longitudinal direction of the panel in case the panel is substantially longitudinal. It is for example conceivable that the cavities extend in a combination of longitudinal and lateral directions. It is also conceivable that some or all cavities are substantially centrally positioned in the panel and/or do not extend to the (outer) edges of the panel. It is further conceivable that the cavities are positioned at a predetermined distance from another. It is also possible that the cavities form a network of interconnected cavities. This embodiment may in particular be beneficial as sound waves may travel through such interconnected cavities that sound travels through. The sound wave may lose its energy through friction between the air particles and the walls of the cavities where it is passing through.

The panel according to the present invention may comprise at least one pair of opposing (side) edges, said pair of opposing (side) edges comprising complementary coupling parts configured for mutual coupling of adjacent panels. The coupling parts of the panel may for example be interlocking coupling parts, which are preferably configured for providing both horizontal and vertical locking. Interlocking coupling parts are coupling parts that require elastic deformation, a click or a movement in multiple directions to couple or decouple the parts with or from each other. Any suitable interlocking coupling parts as known in the art could be applied. A non-limiting example is an embodiment wherein a first edge of said first pair of opposing edges comprises a first coupling part, and wherein a second edge of said first pair of opposing edges comprises a complementary second coupling part, said coupling parts allowing a plurality of panels to be mutually coupled; wherein the first coupling part comprises a sideward tongue extending in a direction substantially parallel to a plane defined by the panel, and wherein the second coupling part comprises a groove configured for accommodating at least a part of the sideward tongue of another panel, said groove being defined by an upper lip and a lower lip.

It is conceivable that the panel comprises at least one backing layer preferably attached to the bottom surface of the core layer. The backing layer may provide a protective function for the core layer, and thus for the panel as such. The backing layer may for example comprise an adhesive layer. This may then enable glue down installation of the panel according to the present invention. It is also conceivable that the backing layer is a balancing layer, preferably configured for stabilization and/or protection of the panel. A balancing layer may for example prevent cupping, warping and/or bowing of the panel. The balancing layer could also be referred to as stabilizing layer. It is also conceivable that at least one balancing layer is attached to top surface of the core layer. Possibly, the panel comprises a first balancing layer attached to the top surface of the core layer and a second balancing layer attached to the bottom surface of the core layer. The balancing layer may comprise lignocellulose and a cured resin. It is possible that the backing layer is substantially free of cavities. In such embodiment, the bottom surface of the core layer is provided with the cavities and the backing layer substantially fully covers said bottom surface of said core layer. The backing layer may thereby substantially seal the cavity or cavities. However, it is also conceivable that the cavities extends from the backing layer into the core layer. Hence, the shape of the cavities of the backing layer may follow, or substantially equal, the shape of the cavities of the bottom surface of the core layer. In either way, the presence of a backing layer may further contribute to the acoustic performance of the panel as the backing layer may have sound dampening properties and/or to the ease of installation of the panel. Further, the backing layer may form a moist barrier. The backing layer is typically made of a polymer material, for example but not limited to polyurethane. It is also conceivable that the panel comprises a combination of any of the mentioned examples of possible backing layers. Further, the backing layer may also be a sound absorbing layer. Such sound absorbing backing layer may further contribute to the good acoustic properties of the panel. Such backing layer may also be referred to as acoustic layer. The backing layer may be composed of a foamed layer, preferably a low density foamed layer, of ethylene-vinyl acetate (EVA), irradiationcrosslinked polyethylene (IXPE), expanded polypropylene (XPP) and/or expanded polystyrene (XPS). However, it is also conceivable that the backing layer comprises nonwoven fibers such as natural fibers like hemp or cork, and/or recycled/recyclable material such as PET. The backing layer, if applied, preferably has a density between 65 kg/m3 and 300 kg/m3, most preferably between 80 kg/m3 and 150 kg/m3.

It is beneficial if the cavities have a depth which is at least 20% of the total thickness of the panel. With the depth of the cavity a distance measure in the same spatial orientation as the thickness of the panel is considered. In general, in an assembled condition wherein panels are forming a floor covering, both the thickness of a panel and the dept of a cavity can be determined in a vertical orientation. It is also possible that the cavities have a depth which is at least 30% of the total thickness of the panel. Preferably, the depth of the cavities is not larger than 55% of the total thickness of the panel. The latter may prevent that deflection of the panel occurs when load is applied on top of the panel.

Panel according to any of the previous claims, wherein adjacent cavities are separated by at least one separating wall, making integral part of the core layer, wherein preferably the thickness of the separating wall is less than 50%, preferably less than 20% of the maximum width W of each of the adjacent cavities. Said at least one separating wall could be multidirectional on a plane defined by the bottom surface of the core layer. The bottom surface of the core layer can be composed of an impressed portion formed by said plurality of impressed cavities and a remaining unimpressed portion, wherein the footprint of the impressed portion covers at least 50%, preferably at least 70% of the surface area of the bottom surface of the core layer.

Due to the combination of rigidity and sound absorbing performance, a relatively thin panel could be applied. Preferably, the thickness of the panel is smaller than 3.5 cm, more preferably smaller than 2.75 cm. It is for example possible that the thickness of the panel is between 0.5 and 3 cm, preferably between 0.7 and 2.5 cm. Such thickness is substantially smaller than the thickness of a conventional acoustic (wall, floor or ceiling) panel.

In a further preferred embodiment, the planar surface area of the bottom surface of the core layer, is at least 30% less than the planar surface area of the top surface of the core layer. It is experimentally found that this difference further contributes to the acoustic performance of the panel whilst not affecting the rigidity and/or stability of the panel. The top surface of the core layer is typically substantially even and free of cavities.

It is possible that the cavities have a substantially curvilinear geometric cross section. This may be a cross section of the panel seen from a perpendicular direction with respect to a plane defined by the bottom surface of the core layer. This may further contribute to the desired absorption, transmission, reflection, refraction and/or the diffraction of sounds waves interacting with the panel. It is also possible that the cavities have a substantially curvilinear geometric shape within a plane defined by the bottom surface. Such shape may also contribute to the sound distribution within the material. It is further conceivable that part of the core layer which encloses a cavity has a structured surface. It is for example possible that the surface of the core layer enclosing the cavity is at least partially structured. This may also be a profiled or rough surface. Hence, the core layer may be partially provided with a profiled surfaced, preferably near or at the area defining a cavity. It is further conceivable that at least part of the cavities is substantially cylindrical, pyramidical and/or conical. At least part of a cavity may for example be formed by a substantially half cylinder, in particular in a plane of the bottom surface. The depth of the cavities may vary over the length and/or width of the cavity. In particular, the shape of the cavities is to be chosen such that they provide enhanced dissipation of impact and/or airborne sound. Preferably, the geometric shape of at least one, and preferably all cavities, in the bottom surface of the core layer do not induce a difference in length- or crosswise flexibility of the floor panel. Hence, the geometric shape of the cavities is chosen such that it they do not negatively influence the rigidity of the panel. Preferred shapes of cavities include at least one shape chosen from the group of polygons, curvilinear shapes and/or combinations thereof. This includes honeycomb, herringbone, waffle, wave-like patterns, crisscross patterns, grids, radial patterns, quilt-like patterns, or repetitive patterns of polygons (triangular, quadrilateral, pentagon, hexagon, heptagon, octagon, nonagon, or N-gons where N>10), quadrilaterals (square, rectangular, trapezoids, rhombus, parallelogram, diamond, etc.), ellipsis, trefoil, quatrefoil, circles, semi-circles, curves, or combinations thereof in side-by-side patterns, circumscribed, inscribed, randomized patterns comprised of the aforementioned shapes and patterns. Other preferred designs of the cavities include triangular wedges, egg tray-shaped designs, alternating horizontal and vertical ridges, parametric acoustic surfaces, offset pyramids or pyramids with polygon base (triangular, quadrilateral, pentagon, hexagon, heptagon, octagon, nonagon, or N-gon where N>10), radial designs, or series of wells or troughs with different depths.

In a further preferred embodiment, the cavities may be at least partially filled with a filler material such as sound absorbing material and/or soundproofing material. This may further contribute to the sound absorbing character of the panel, and thus to the acoustic properties thereof. The sound absorbing material may for example be a natural material, such as bamboo, coco fibers and/or cork. Further non-limiting examples of sound absorbing material which could be used for the present invention are mineral wool, fiberglass, RPET felt, EVA, PE foam, PP foam, and/or polystyrene foam. In a further possible embodiment, the cavities may be substantially completely filled with sound absorbing material. In a further possible embodiment, the sound absorbing material may cover at least part of the back surface of the panel, forming a further sound attenuating barrier. It is conceivable that this sound absorbing material includes vibrating bodies and/or barriers of different densities. It is conceivable that this attenuating barrier features a spatially varied density able to absorb different wavelengths. It is possible that this sound absorbing material forms an interlocking structure with the cavities present in the bottom surface of the panel, thereby forming a structure inverse to the exposed cavities present in the bottom surface of the panel.

It is further conceivable that at least one core layer is composed of a composite material comprising at least 40% by weight of mineral material, preferably at least 50% by weight, more preferably at least 60% by weight. It is also possible that the core layer comprises at least 80% by weight of mineral material. A higher mineral content typically results in a more rigid panel. Moreover, due to the relatively large quantity of mineral material and the relatively low quantity of thermoplastic material in the composite core layer, a significantly improved temperature resistance can be obtained, in particular with respect to conventional floor panel having a core which is predominantly PVC based.

Hence, the panel according to the invention does no longer suffer from undesired shrinking and expansion due to seasonal and/or local temperature changes.

It is conceivable that at least one core layer comprises at least one mineral material selected from the group consisting of: magnesium oxide, calcium carbonate, chalk, clay, calcium silicate and/or talc. These materials have proven to impart a sufficient rigidity to the composite material. As a further non-limiting example, limestone (e.g. calcium carbonate with magnesium carbonate) may be used as mineral material in the core layer. Possibly, the mineral material is present as particulate mineral filler.

Typically, the core layer of a panel according to the present invention is composed of a composite material comprising a mixture of mineral material and thermoplastic material. Non limiting examples of thermoplastic material are polyvinyl chloride (PVC), polyethylene (PE), polyurethane (PU), acrylonitrile butadiene styrene (ABS) and/or polypropylene (PP). The thermoplastic material may also be a vinyl containing thermoplastic material. The core layer may also comprise a mixture of aforementioned materials. Generally, the ratio of weight percentages of mineral material relative to thermoplastic material is at least 1. Preferably, the composite material comprises at least 15% by weight of thermoplastic material. This lower limit is found to be sufficient to secure sufficient stability and strength of the core layer. The composite material preferably comprises a maximum of 40% by weight of thermoplastic material. This maximum is preferred in order to improve the rigidity of the core layer as well as to seriously improve the temperature resistance of the core layer.

The panel, and in particular the core layer may further comprise at least one binder. Preferably, the ratio of weight percentages of mineral material relative to said binder is at least 1.

The core layer may further comprise at least one additive chosen from the group consisting of: a pigment, an impact modifier, a lubricant, a stabilizer, a wax, and/or an aid processing agent. Various pigments, such as inks, to impart colour to the composite layer. If applied, pigments are commonly present in an amount of 0-5% by weight in the composite layer. As impact modifier, preferably MBS (Methacrylate-Butadiene-Styrene), CPVC (chlorinated PVC), ABS (acrylonitrile butadiene styrene) or TPE (thermoplastic elastomer) is used, which is more preferably present in an amount of 0-5% by weight in the composite core layer. Also, at least one lubricant may be present and more preferably an internal lubricant and an external lubricant. The optional stabilizer can be selected for effectiveness with the particular polymer used and may for example be a calcium zinc stabilizer. Preferably, the total amount of additives present in the composite core layer is restricted to 1-15% by weight, more preferably 5-15% by weight, and most preferably 8-12% by weight. The core layer is in a possible embodiment substantially free of natural organic fibres, and in particular substantially free of wood (for example wood fibres, and including wood dust, and bamboo dust).

The panel according to the present invention is possibly substantially rectangular, but may also be substantially rhombic, or substantially polygonal. In a preferred embodiment, the flexibility of the panel in the longitudinal direction is substantially equal to the flexibility of the panel in the lateral direction. For example in case of a substantially square or square-ish panel, it is also conceivable that the flexibility of the panel in a first direction is substantially equal to the flexibility in a second direction, wherein the first direction and the second direction are defined within the same plane surface and wherein the directional component of the first direction is substantially perpendicular to directional component of the second direction. With substantially equal it is meant that the average measuring deviation between the longitudinal and lateral direction is within 10%, and preferably within 5%. A benefit of such embodiment is that a relatively rigid and stable panel can be obtained. The cavities, are preferably positioned such that the flexibility of the panel is not significantly affected, in particular in at least one direction, and possibly in a single direction. It is for example conceivable that the cavity/cavities is/are positioned such that it does not affect the flexibility in a first direction, for example, but not limited to, the longitudinal direction.

The modulus of rigidity of the panel is preferably at least 2500 MPa. In a further preferred embodiment, the modulus rigidity of the panel in the longitudinal direction is at least 2500 MPa and/or wherein the modulus rigidity of the panel in the lateral direction is at least 2500 MPa when measured according to the EN 310 standard. The bottom structure of the core layer of the panel according to the present invention has therefore a positive effect on the stability, pressure distribution and strength of the panel in both longitudinal and lateral directions. This is a marked improvement over the prior art, which panels suffer from reduced modulus of rigidity perpendicular to the direction of the recesses or grooves formed through subtractive manufacturing processes.

It is conceivable that the core layer is an extruded layer formed via an extrusion process. A benefit of a core layer being formed via an extrusion process is that the panels can be produced in a relatively cheap way. Further, an extruded core layer is found to be advantageous in regard of the rigidity obtained, as well as being capable of forming a fusion bonding with the top layer. Here, the extrusion process and the fusion process can be performed simultaneously during production of the panel. It is in particular beneficial if the cavities are formed immediately after the extrusion process, before or during lamination with a decorative layer. In this manner it can be prevented that material is to be removed from the core after production of the panel. Hence, the panel can be produced in a more efficient way. Further, it is prevented that residual material is formed. It is also conceivable that the cavities are formed substantially immediately after an extrusion process. In this context, it is meant that the cavities are formed prior to the core being solidified. It is therefore meant that the cavities are formed in the back surface of the core layer when the core has a malleable consistency or viscosity, therefore not being rigid.

In another possible embodiment, it is conceivable that the core layer is formed via hot-pressing. For this technique it is possible that the cavities is formed during production and/or that the cavities is provided afterward production of the panel. Hot pressing may positively contribute to the rigidity of the panel. It is also conceivable that the core layer is formed via a curing process. It is therefore meant that the cavities are formed in the back surface of the core when the core has a malleable consistency or viscosity, therefore is not rigid. It is conceivable that the cavities are formed in the back surface of the core through an imprinting process, preferably rotary imprinting. It is also conceivable that at least one cavity is formed in the back surface through other methods such as a heating and/or pressing process, etching, milling, engraving, stamping, embossing, subtractive manufacturing, additive manufacturing, or combinations thereof.

The panel may further comprise at least one reinforcement layer. Non-limiting examples of such reinforcement layer are fiber glass, polypropylene, jute, cotton and/or polyethylene terephthalate. It is in particular beneficial if the reinforcement layer is at least partially impregnated with a thermosetting resin. Such thermosetting resin may be selected from the group comprising of: melamine formaldehyde resin, phenolic resins and/or urea formaldehyde. Typically, a reinforcement layer, if applied, is present near the top surface and/or near the bottom surface of the panel. In particular, the reinforcement layer is attached to core layer.

The panel according to the invention may further comprise at least one top layer, preferably a decorative top layer. Such decorative top layer may for example be a high pressure laminate (HPL), a plurality of impregnated layers containing lignocellulose, a wood veneer, a thermoplastic layer containing at least a decorative layer and optionally a protective top layer, a stone veneer or the like, and/or a combination of said decorative layers. The decorative top layer may possibly also comprise at least one ply of cellulose-based layer and a cured resin, wherein the cellulose-based layer is preferably paper or kraft paper. Said ply of cellulose-based material may also be a veneer layer adhered to a top surface of the core layer. The veneer layer is preferably selected from the group consisting of wood veneer, cork veneer, bamboo veneer, and the like. Other decorative top layers that can be considered according to the invention include ceramic tiles or porcelain, a real stone veneer, a rubber veneer, a decorative plastic or vinyl, linoleum, and decorative thermoplastic film or foil which may be laminated with a wear layer and optionally a coating. Examples of thermoplastics may be PP, PET, PVC and the like. It is also possible to provide on the top facing surface of the core an optional primer and print the desired visual effect in a direct printing process. The decorative layer can receive a further finishing with a thermosetting varnish or lacquer such as polyurethane, PUR, or a melamine based resin. It is also conceivable that the panel comprises a top layer consisting of a ceramic tile. Such ceramic tile may for example be attached to the top surface of the core layer by means of an adhesive, such as but not limited to polyurethane. It is also conceivable that the top layer is made of a ceramic and/or stone material. Hence, the invention also relates to a panel, in particular a floor panel, a wall panel, or a ceiling panel, comprising at least one core layer comprising a composite material, the composite material preferably comprising at least 20% by weight of mineral material, the core layer having a top surface and a bottom surface, wherein at least part of the bottom surface of the core layer is provided with the cavities extending towards the top surface, and wherein the panel comprises at least one top layer attached to the top surface of the core layer, the top layer comprising a stone and/or ceramic material. Preferably, the top layer is a stone and/or ceramic tile.

The invention also relates to a method for producing a panel, in particular a floor panel, a wall panel, or a ceiling panel, preferably according to the present invention, the method comprising the steps of:

providing a composite material, preferably a substantially moldable composite material, the composite material comprising at least 20% by weight of mineral material, and preferably at least one binder, forming a core layer of said composite material wherein said core layer has a top surface and a bottom surface, impressing a plurality of cavities in at least part of the bottom surface, and preferably enabling hardening and/or curing of the core layer.

Forming of the core layer may for example be done via extrusion. It is conceivable that at least part of cavities is obtained via rotary imprinting and/or rotary (die) cutting. It is also conceivable that step c) is performed by guiding the core layer through at least two rollers, wherein at least one of the rollers is provided with a surface structure configured to provide a plurality of cavities in at least part of the bottom surface of the core layer. The shapes and/or dimensions cavities can be any of the cavities mentioned for the panel according to the present invention. The method may further comprise the step of providing and attaching at least one backing layer to the bottom surface of the core layer and/or providing and attaching at least one top layer to the top surface of the core layer. The method may also comprise the step of machining of at least two edges of the panel which that complementary coupling parts are provided.

The invention will now be elucidated into more detail with reference to the following non-limitative clauses.

1. Panel, such as a floor panel, a wall panel or a ceiling panel, in particular a decorative panel, comprising:

at least one core layer, the core layer comprising at least 20% by weight of a mineral material, wherein the core layer comprises a top surface and a bottom surface, and wherein at least part of the bottom surface of the core layer is provided with a plurality of impressed cavities.

2. Panel according to clause 1, wherein the plurality of impressed cavities define a repeated cavity pattern.

3. Panel according to any of the previous clauses, wherein at least one cavity has, and preferably a plurality of cavities have, a maximum width W and a maximum length L, wherein the ratio between the maximum width W and the maximum length L is between 0.2 and 1, preferably between 0.5 and 1.

4. Panel according to any of the previous clauses, wherein adjacent cavities are separated by at least one separating wall, making integral part of the core layer, wherein preferably the thickness of the separating wall is less than 50%, preferably less than 20% of the maximum width W of each of the adjacent cavities.

5. Panel according to clause 4, wherein at least one separating wall extends in multiple directions with respect to a plane defined by the bottom surface.

6. Panel according to any of the previous clauses, wherein the bottom surface of the core layer is composed of an impressed portion formed by said plurality of impressed cavities and a remaining unimpressed portion, wherein the footprint of the impressed portion covers at least 50%, preferably at least 70% of the surface area of the bottom surface of the core layer.

7. Panel according to any of the previous clauses, wherein the shapes, in particular the cross-sectional shapes, of a number of cavities are chosen from the group of polygons, curvilinear shapes and/or combinations thereof.

8. Panel according to any of the previous clauses, wherein a number of cavities is substantially prism shaped comprising a prism base chosen from the group consisting of: a curvilinear prism base, a circular prism base, an n-sided polygonal prism base, wherein $n \geq 3$.

9. Panel according to any of the previous clauses, wherein the depth of at least one cavity varies as seen in at least one cross-sectional direction of said cavity.

10. Panel according to any of the previous clauses, wherein the depth of at least a number of cavities is situated in between 10 and 30% of the maximum thickness of the core layer.

11. Panel according to any of the previous clauses, wherein the panel is a rectangular panel defining a first longitudinal direction, wherein at least of number of cavities has an elongated shape defining a second longitudinal direction, wherein the first longitudinal direction and the second longitudinal direction mutually enclose an angle, preferably an angle falling within the range of 30-90 degrees.

12. Panel according to any of the previous clauses, wherein at least a number of cavities is configured to attenuate sound, preferably sound with a frequency of ranging from 20-25,000 Hz, preferably 2,000-20,000 Hz, more preferably 8,000-16,000 Hz.

13. Panel according to any of the previous clauses, wherein the maximum length and/or maximum width of at least a number of cavities ranges from 2 to 15 mm, most preferably 5 mm to 10 mm.

14. Panel according to any of the previous clauses, wherein the volume of at least a number of cavities ranges from 5 cubic millimetre to 2 cubic centimetre, preferably from 0.1 cubic centimetre to 0.6 cubic centimetre.

15. Panel according to any of the previous clauses, comprising at least one backing layer, wherein the backing layer, preferably forming a sound attenuating barrier, covers at least part of the bottom surface of the bottom layer.

16. Panel according to clause 15, wherein at least part of the sound attenuating barrier includes vibrating materials.

17. Panel according to clause 15 or 16, wherein at least part of the sound attenuating barrier forms a structure inverse to the impressed cavities.

18. Panel according to any of the previous clauses, wherein the panel comprises at least one pair of opposing edges, said pair of opposing side edges comprising complementary coupling parts configured for mutual coupling of adjacent panels.

19. Panel according to any of the previous clauses, wherein the core layer comprises at least 40% by weight of mineral material, preferably at least 50% by weight, more preferably at least 60% by weight.

20. Panel according to any of the previous clauses, wherein the core layer comprises at least one mineral material selected from the group consisting of: magnesium oxide, magnesium chloride, magnesium sulfate, calcium carbonate, chalk, clay, calcium silicate and/or talc.

21. Panel according to any of the previous clauses, wherein the core layer comprises at least one binder, and preferably wherein the ratio of weight percentages of mineral material relative to said binder is at least 1.

22. Panel according to clause 21, wherein the binder is an organic binder, including thermoplastic binders such as PVC, PP, PET, PU, and thermosetting binders such as melamine; and/or an inorganic binder such as MgO cement, hydraulic cements, calcium aluminate cements, geopolymers and the like.

23. Panel according to any of the previous clauses, wherein the core layer further comprises at least one additive chosen from the group consisting of: a pigment, an impact modifier, a lubricant, a stabilizer, a wax, and/or an aid processing agent.

24. Panel according to any of the previous clauses, wherein the flexibility of the panel in the longitudinal direction is substantially equal to the flexibility of the panel in the lateral direction.

25. Panel according to clause 24, wherein the modulus of rigidity of the panel is at least 2500 MPa, wherein, preferably, the modulus of rigidity of the panel in the longitudinal direction is at least 2500 MPa and/or the modulus of rigidity of the panel in the lateral direction is at least 2500 MPa.

26. Panel according to any of the previous clauses, wherein the core layer is an extruded layer formed via an extrusion process, or a calendared layer formed via a calendaring process, or a cured layer formed via a curing process.

27. Panel according to any of the previous clauses, wherein the cavities are formed during an extrusion process, or substantially immediately after an extrusion process, or through hot-pressing, or through a curing process.

28. Panel according to any of the previous clauses, comprising at least one top layer, preferably a decorative top layer, either directly or indirectly, affixed to the core layer.

29. Panel according to any of the previous clauses, wherein the cavities do not extend to and/or through an outer edge of the panel.

30. Method for producing a panel, in particular a floor panel, a wall panel, or a ceiling panel, preferably according to any of clauses 1-29, comprising the steps of:

providing a composite material, preferably a substantially malleable composite material, comprising at least 20% by weight of mineral material, forming a core layer of said composite material wherein said core layer has a top surface and a bottom surface, impressing a plurality of cavities in at least part of the bottom surface of the core layer, and enabling hardening and/or curing of the core layer.

31. Method according to clause 30, wherein the core layer is formed via an extrusion, calendaring, or curing process.

32. Method according to clause 30 or 31, wherein at least part of cavities is obtained via imprinting, rotary imprinting and/or rotary (die) cutting.

33. Method according to any of clauses 30-32, wherein impressing of the core layer is performed by guiding the core layer through at least two rollers, wherein at least one of the rollers is provided with a surface structure configured to provide a plurality of cavities in at least part of the bottom surface of the core layer.

Figure 3A:
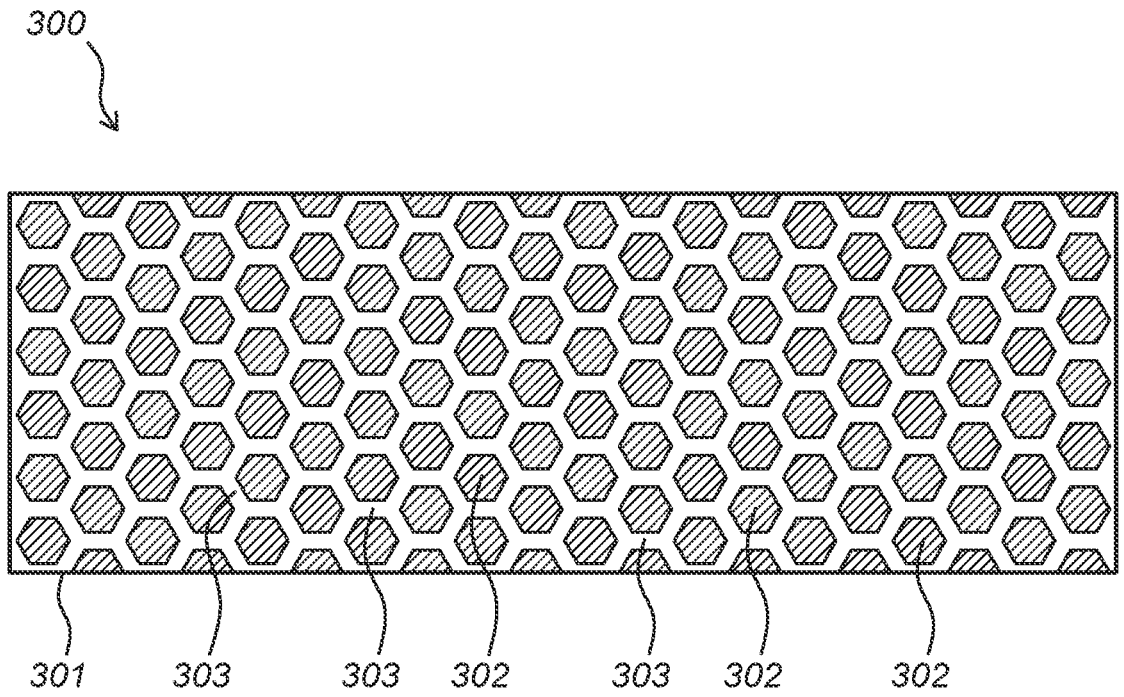
Figure 3B:
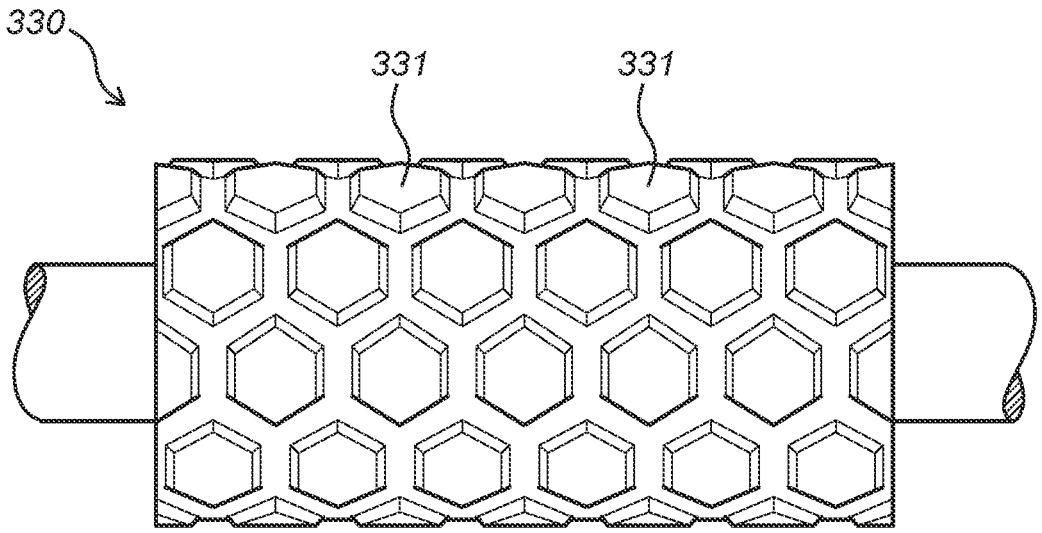
Figure 3C:
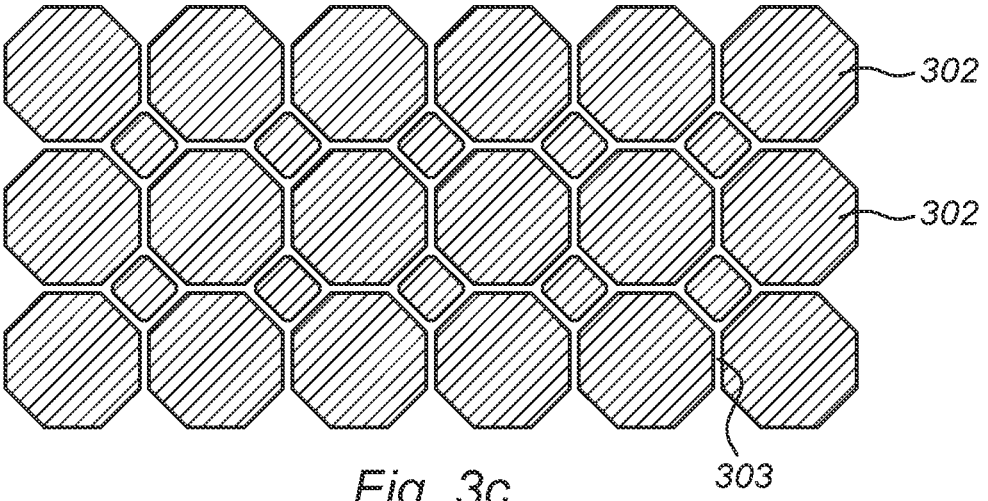
Figure 3D:
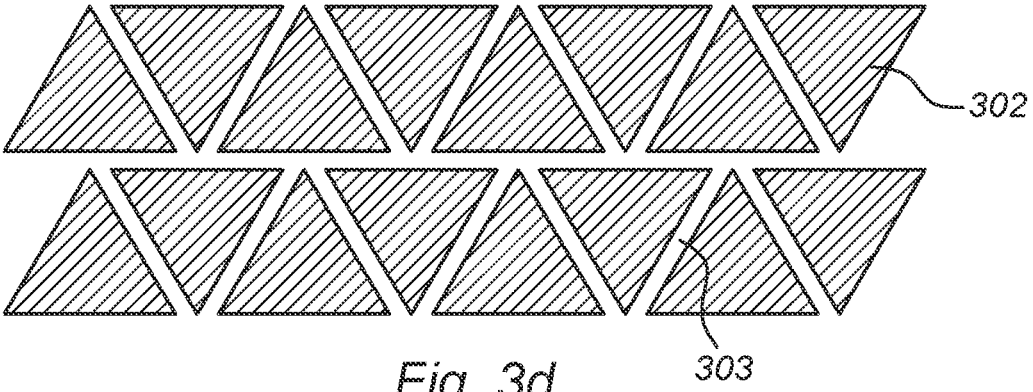
Figure 3E:
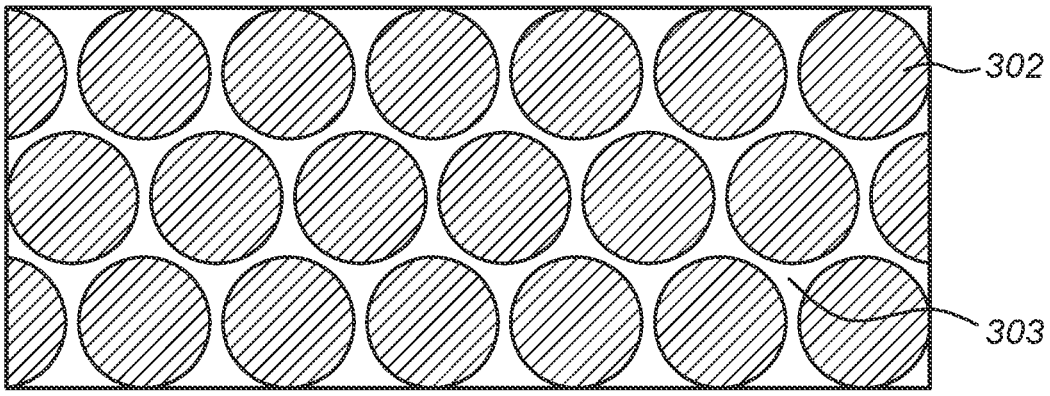
Figure 3F:
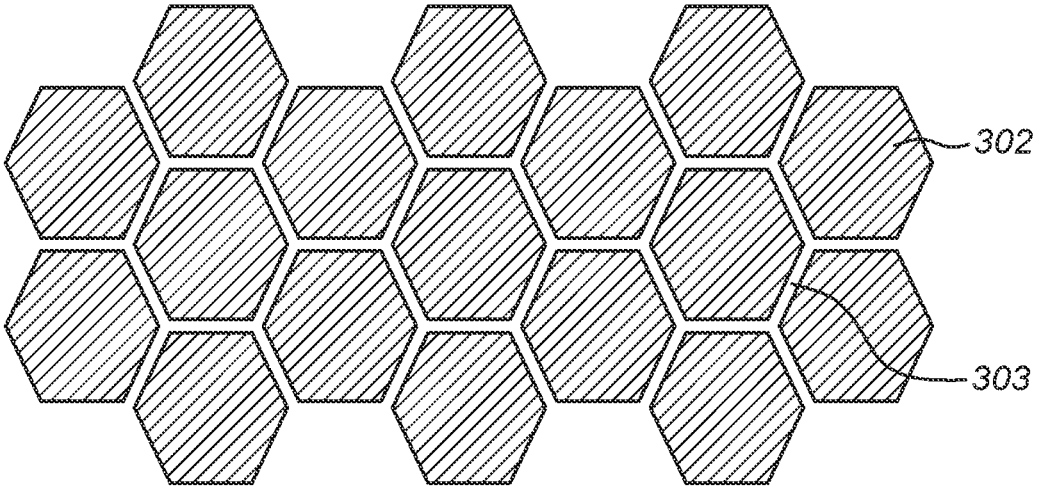
Figure 3G:
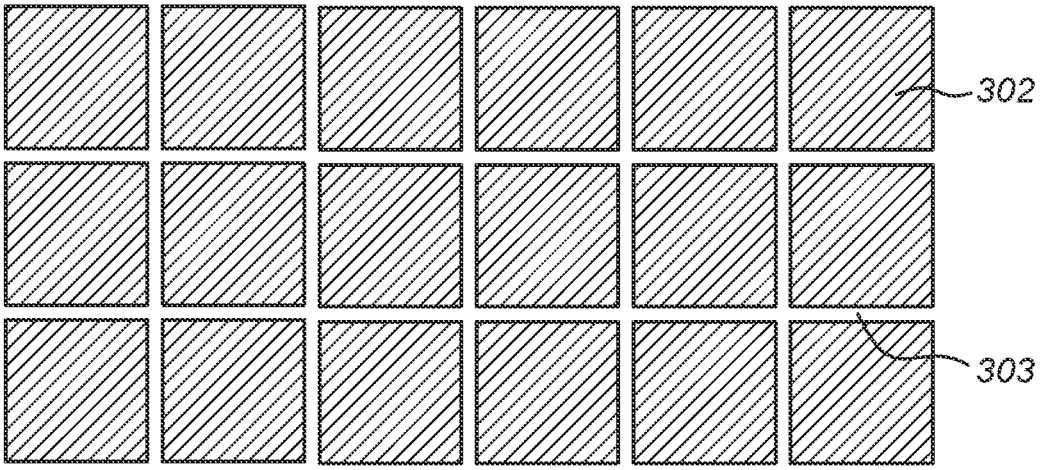
Figure 3H:
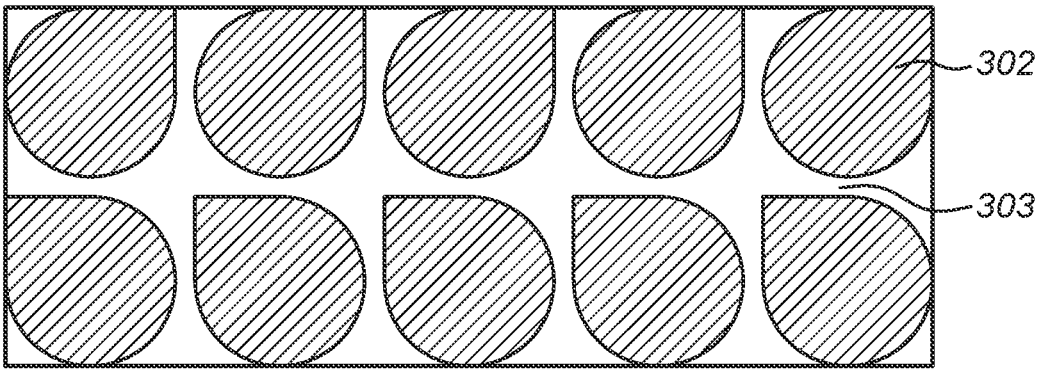
Figure 4A:
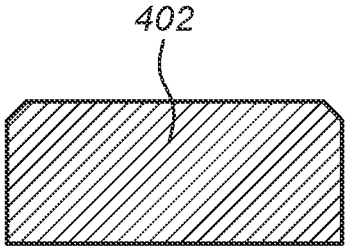
Figure 4B:
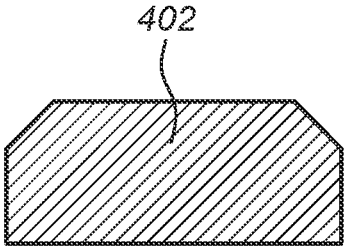
Figure 4C:
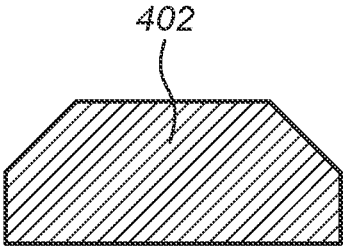
Figure 4D:
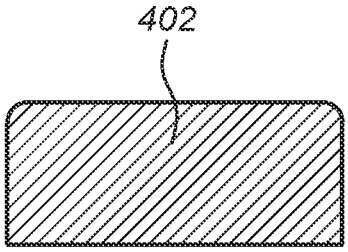
Figure 4E:
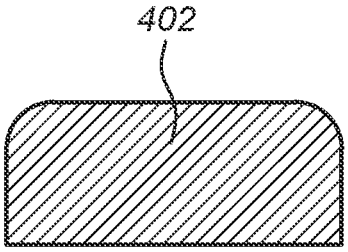
Figure 4F:
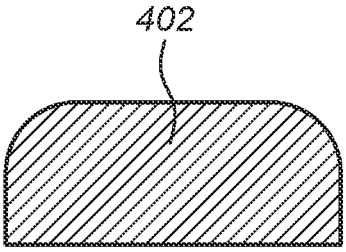
Figure 4G:
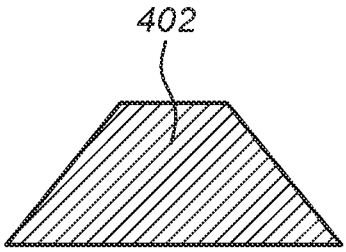
Figure 4H:
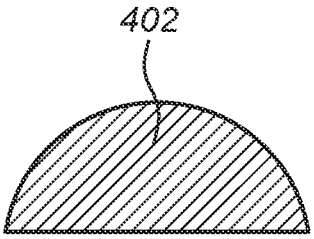
Figure 4I:
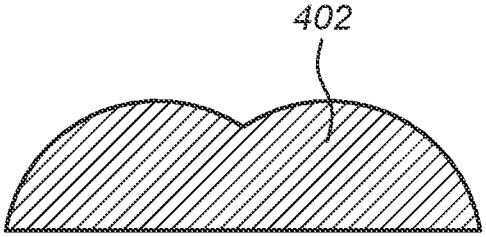

The invention will now be elucidated into more detail with reference to the following non-limitative figures. Herein show:

FIGS. 1*a*-1*d* each a bottom view of possible embodiments of a panel according to the present invention;

FIGS. 2*a*-2*e* each a cross section of possible embodiments of a panel according to the present invention;

FIG. 3*a* a bottom view of another possible embodiment of a panel according to the present invention;

FIG. 3*b* a roller which could be applied to manufacture a panel according to the present invention;

FIGS. 3*c*-3*h* a bottom view of various possible embodiments of a panel according to the present invention; and FIGS. 4*a*-4*i* cross sectional view of various possible embodiments of cavities according to the present invention.

Within these figures, similar references correspond to similar or equivalent components and/or technical features.

FIGS. 1*a*-1*d* shows schematic representations of possible embodiments of panels 100 according to the present invention. The figures show a bottom view of the panel 100. Each panel 100*a*, 100*b*, 100*c*, 100*d* can for example be a floor panel 100, a wall panel 100, or a ceiling panel 100. Each panel comprises a core layer 101, preferably comprising a composite material comprising a mixture of mineral material and thermoplastic material. Each core layer 101 has a top surface (not shown) and a bottom surface which is shown in the picture. Part of the bottom surface of the core layer 101 of each panel 100*a*, 100*b*, 100*c*, 100*d* is provided with the cavities 102 which extend towards the top surface of the core layer 101. In the shown embodiments, the panels 100*a*, 100*b*, 100*c*, 100*d* are not provided with (interlocking) coupling means. However, it is conceivable that said coupling means are applied.

Figure 1B:
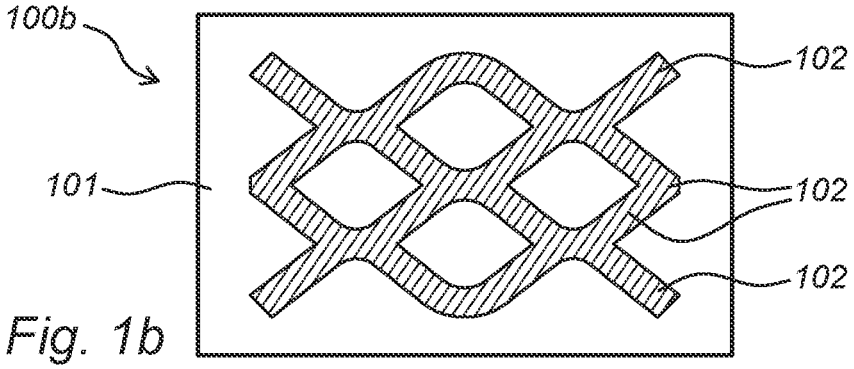
Figure 1C:
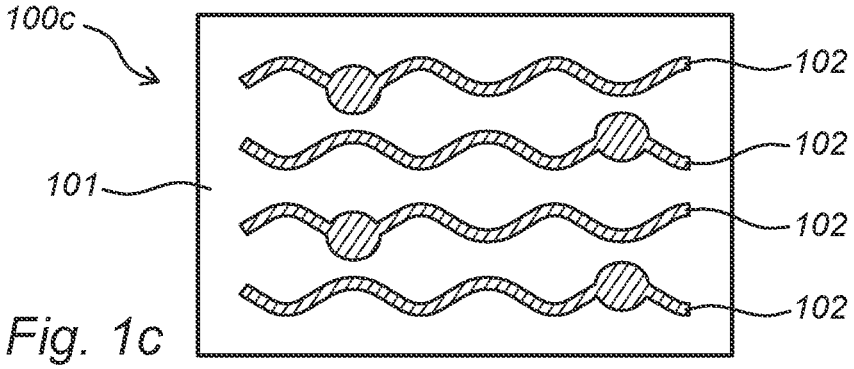
Figure 1D:
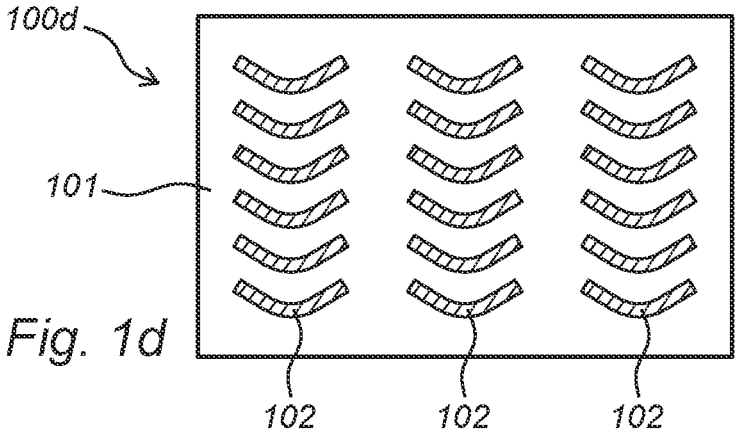

FIG. 1*a* shows a panel 100*a* comprises a plurality of substantially parallel cavities 102. Each cavity 102 is positioned at a predetermined distance from the peripheral edges of the panel 100*a*. It can also be seen that each cavity 102 extends in longitudinal direction of the panel 100*a*. FIG. 1*b* shows a panel 100*b* wherein the cavities 102 form a network of interconnected cavities 102. It is experimentally found that such embodiment may strengthen the sound dampening effect of the panel 100*b*. FIG. 1*c* shows a panel 100*c* with a plurality of individual cavities 102 which extend substantially in the longitudinal direction of the panel 100*c*. The cavities 102 are locally widened. At least the locally widened areas may for example be filled with sound absorbing material. FIG. 1*d* shows a panel 100*d* having series of substantially V-shaped cavities 102. The cavities 102 are positioned at a predetermined distance from another and do not interfere with an adjacent cavity 102.

Figure 2A:
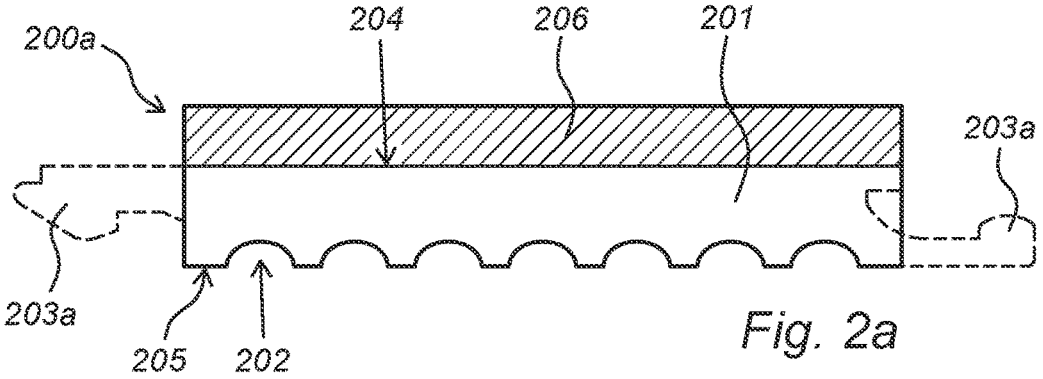

FIG. 2*a*-2*e* show further possible embodiments of panels 200 according to the present invention. Each figure shows a side view of a cross section of a panel 200*a*, 200*b*, 200*c*, 200*d*, 200*e* which could be a floor panel 200, wall panel 200 or ceiling panel 200. FIG. 2*a* shows that the panel 200 can optionally be provided with interconnecting coupling parts 203*a*, 203*b*. Interconnecting coupling parts 203*a*, 203*b* could be applied to any of the embodiments covered by the present invention. Each panel 200 comprises a core layer 201, preferably comprising a composite material comprising a mixture of mineral material and thermoplastic material. Each core layer 201 has a top surface 204 and a bottom surface 205.

Figure 2B:
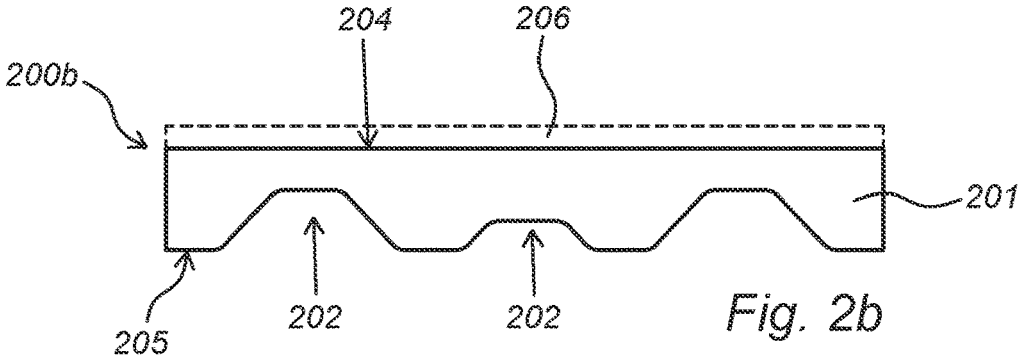

FIG. 2*a* shows a panel 200*a* comprising a plurality of cavities 202 which are positioned at predetermined distance from another. The panel 200*a* further comprises a top layer 206. In the shown embodiment the top layer 206 is a ceramic panel 206 attached to the top surface 204 of the core layer 201. FIG. 2*b* shows a panel 200*b* wherein the depth the cavities 202 differs per cavity 202. The cavities 202 are substantially trapezium shaped in cross section.

Figure 2C:
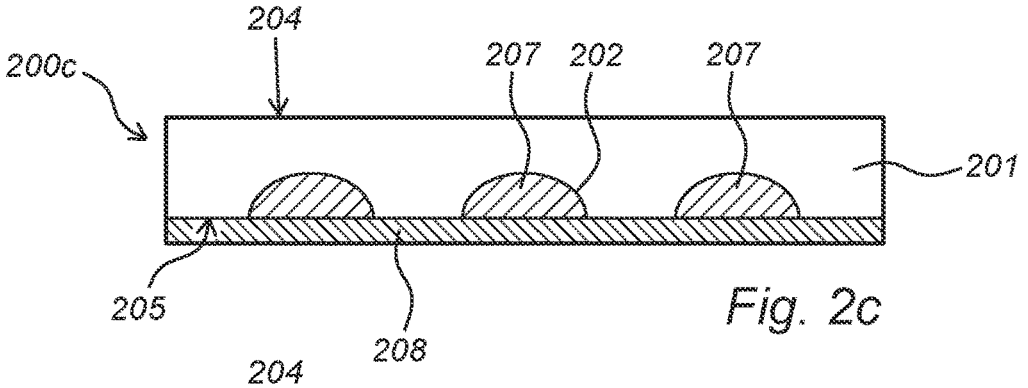
Figure 2D:
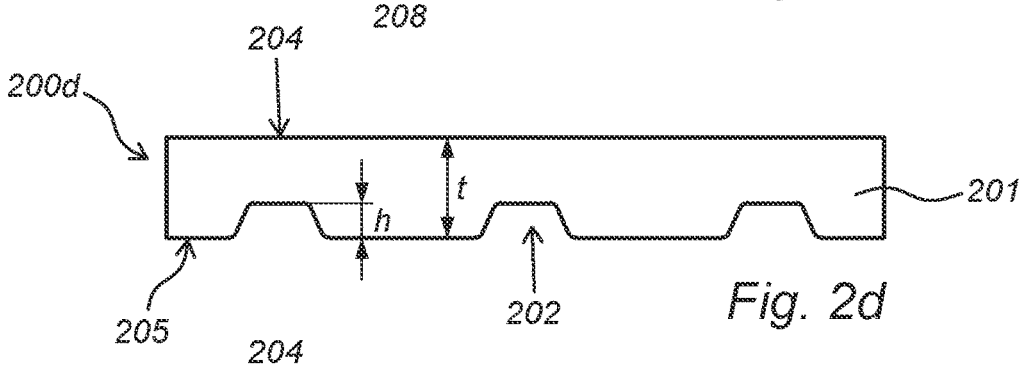
Figure 2E:
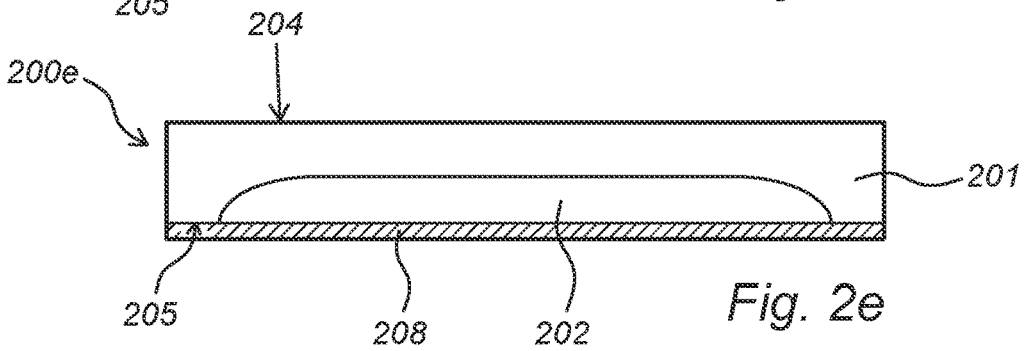

Optionally, the panel 200*b* may comprise a decorative top layer. FIG. 2*c* shows an embodiment wherein the cavities 202 have a cross section which is semicircular. The cavities 202 are filled with sound absorbing material 207. The panel 200*c* further comprises a backing layer 208 which is attached to the bottom surface 205 of the core layer 201. FIG. 2*d* shows that the height, or depth, h of the cavities 202 is at least 20% of the total thickness t of the panel 200*d*. In particular, the depth h of the cavities 202 is about $\frac{1}{3}^{rd}$ of the thickness t of the panel 200*d*. FIG. 2*e* shows a side view of a panel 200*e* wherein it can be seen that the cavity 202 extends over substantially the entire length of the panel 200*e* but that the cavity 202 starts and ends at a predetermined distance from the outer ends of the panel 200*e*. The panel 200*e* further comprises a backing layer 208, in particular a balancing layer 208. The cavity 202 is free of filling material, such as a sound absorbing material.

FIG. 3*a* shows a schematic representations of possible embodiment of a panel 300 according to the present invention. The figure shows a bottom view of the panel 300. The panel comprises a core layer 301, preferably comprising a composite material comprising a mixture of mineral material and thermoplastic material. The core layer 301 has a top surface (not shown) and a bottom surface which is shown in the picture. Part of the bottom surface of the core layer 301 is provided with a plurality of cavities 302. The cavities 302 extends towards the top surface of the core layer 301. The cavities 302 are integrally formed cavities 302. In the shown embodiment, the cavities 302 define a cell pattern, in particular a polygon cell pattern. The figure show that the cavities 302 are separated via partitions 303, wherein at least part of the partitions 303 between the cavities 302 have a thickness which is smaller than the length and/or width of the cavities 302. In the shown embodiment, the cavities 302 are imprinted into the bottom surface of the core layer 301. Hence, the cavities 302 are imprinted cavities 302.

FIG. 3*b* shows a roller 330 which could be applied to manufacture a panel 300 according to the present invention, in particular as shown in FIG. 3*a*. The plurality of cavities can be provided by subjecting at least part of the bottom surface of a core layer to a (rotary) imprinting process. This can be done substantially directly after extrusion of the core layer. It is for example conceivable that the core layer is led through at least two rollers 330, wherein at least one of the rollers is provided with a surface structure 331 configured to provide a plurality of cavities in at least part of the bottom surface of the core layer.

FIGS. 3*c*-3*h* show a bottom view of various further possible embodiments of a panel according to the present invention. The figures are in line with FIG. 3*a*, and show a bottom view of part of a panel according to the present invention. The figures show for each embodiment a plurality of impressed cavities 302, in particular in a repeated pattern. The cavities 302 are separated via partitions 303, wherein at least part of the partitions 303 between the cavities 302 have a thickness which is smaller than the length and/or width of the cavities 302.

FIGS. 4*a*-4*i* show cross sectional views of various possible embodiments of impressed cavities 402 according to the present invention. It can be seen that the cavities 402 have rather clear boundaries, wherefore the cavities 402 could also function as attenuation chambers.

It will be apparent that the invention is not limited to the working examples shown and described herein, but that numerous variants are possible within the scope of the attached claims that will be obvious to a person skilled in the art.

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

The verb "comprise" and conjugations thereof used in this patent publication are understood to mean not only "comprise", but are also understood to mean the phrases "contain", "substantially consist of", "formed by" and conjugations thereof. When it is referred to reinforcing layer also a reinforcing element can be meant, or vice versa. Within the scope of this invention, where the term 'impressed cavity' is used, also the term 'cavity' could be applied, or vice versa.

What is claimed is:

1. A panel comprising:

at least one core layer, the core layer comprising at least 20% by weight of a mineral material, wherein the core layer comprises a top surface and a bottom surface, wherein at least part of the bottom surface of the core layer is provided with a plurality of impressed cavities, wherein the panel is one of a floor panel, a wall panel or a ceiling panel, and wherein the plurality of impressed cavities is substantially prism shaped comprising a prism base chosen from the group consisting of: a curvilinear prism base, a circular prism base, and an n-sided polygonal prism base, wherein $n \geq 3$.

2. The panel according to claim 1, wherein the plurality of impressed cavities define a repeated cavity pattern.

3. The panel according to claim 1, wherein a plurality of cavities have, a maximum width W and a maximum length L, wherein the ratio between the maximum width W and the maximum length L is between 0.2 and 1.

4. The panel according to claim 1, wherein adjacent cavities are separated by at least part of the core layer, wherein the thickness of the core layer between the adjacent cavities is less than 50% of a maximum width W of each of the adjacent cavities.

5. The panel according to claim 4, wherein at least one separating wall extends in multiple directions with respect to a plane defined by the bottom surface.

6. The panel according to claim 1, wherein the bottom surface of the core layer is composed of an impressed portion formed by said plurality of impressed cavities and a remaining unimpressed portion, wherein the footprint of the impressed portion covers at least 50%, of the surface area of the bottom surface of the core layer.

7. The panel according to claim 1, wherein the cross-sectional shapes, of a number of cavities are chosen from the group of polygons, curvilinear shapes and/or combinations thereof.

8. The panel according to claim 1, wherein the depth of at least a number of cavities extends between 10 and 30% into the thickness of the core layer.

9. The panel according to claim 1, wherein at least a number of cavities is configured to attenuate sound with a frequency of ranging from 500 to 10,000 Hz.

10. The panel according to claim 1, wherein the volume of at least a number of cavities ranges from 5 cubic millimetre to 2 cubic centimetre.

11. The panel according to claim 1, wherein the core layer comprises at least 40% by weight of mineral material.

12. The panel according to claim 1, wherein the core layer comprises at least one mineral material selected from the group consisting of: magnesium oxide, magnesium chloride, magnesium sulfate, calcium carbonate, chalk, clay, calcium silicate and/or talc.

13. The panel according to claim 1, wherein the core layer comprises at least one binder, wherein the ratio of weight percentages of mineral material relative to said binder is at least 1.

* * * * *